US006251161B1

(12) United States Patent
Tateishi et al.

(10) Patent No.: US 6,251,161 B1
(45) Date of Patent: Jun. 26, 2001

(54) METHOD FOR OPERATING MOVING HEARTH REDUCING FURNACE

(75) Inventors: Masataka Tateishi, Kakogawa; Koichi Matsushita, Tokyo; Hidetoshi Tanaka; Takao Harada, both of Kakogawa, all of (JP)

(73) Assignee: Kabushiki Kaisha Kobe Sieko Sho (Kobe Steel, Ltd.), Kobe (JP)

( * ) Notice: Subject to any disclaimer, the term of this patent is extended or adjusted under 35 U.S.C. 154(b) by 0 days.

(21) Appl. No.: 09/384,398

(22) Filed: Aug. 27, 1999

(30) Foreign Application Priority Data

Aug. 27, 1998 (JP) ..... 10-241713

(51) Int. Cl.[7] ..... C21B 13/08
(52) U.S. Cl. ..... 75/484; 266/177
(58) Field of Search ..... 75/484; 266/177

(56) References Cited

U.S. PATENT DOCUMENTS 3,443,931 * 5/1969 Beggs et al. ..... 75/484
3,452,972 * 7/1969 Beggs ..... 75/484
4,676,741 6/1987 Pargeter .
4,701,214 10/1987 Kaneko et al. .
5,730,775 3/1998 Meissner et al. .
6,015,527 * 1/2000 Kamei et al. ..... 75/484

FOREIGN PATENT DOCUMENTS 649 096 4/1985 (CH) .
372120 5/1932 (GB) .
WO 98/21538 5/1998 (WO) .
WO 99/16912 4/1999 (WO) .
WO 99/16913 4/1999 (WO) .

* cited by examiner

*Primary Examiner*—Melvyn Andrews
(74) *Attorney, Agent, or Firm*—Oblon, Spivak, McClelland, Maier & Neustadt, P.C.

(57) ABSTRACT

A moving hearth reducing furnace is operated, while a gap is provided between a discharging apparatus for discharging reduced iron agglomerates from the moving hearth reducing furnace and the surface of the moving hearth. The gap prevents squeezing metallic iron powder formed by reduction of powder included in iron oxide agglomerates into the surface of the moving hearth and the formation of an iron sheet. An iron oxide layer formed on the moving hearth during the operation can be periodically scraped off without shutdown of the furnace.

12 Claims, 13 Drawing Sheets

METHOD FOR OPERATING MOVING HEARTH REDUCING FURNACE

BACKGROUND OF THE INVENTION

1. Field of the Invention

The present invention relates to a method for operating a moving hearth reducing furnace, in which iron oxide agglomerates incorporated with a carbonaceous material are reduced to iron.

2. Description of the Related Art

A typical method for preparing reduced iron is a MIDREX process. In this method, a reducing gas, such as natural gas, is blown into a shaft furnace through a tuyere. The reducing gas flows in and comes contact with iron ore or iron oxide pellets filled in the furnace. Thus, iron oxide is reduced in a reducing atmosphere in the furnace to form reduced iron. This method using a large amount of expensive natural gas, however, inevitably results in high production costs.

Recently, processes for making reduced iron using inexpensive coal in place of the natural gas have attracted attention. For example, U.S. Pat. No. 3,443,931, which is hereby fully incorporated by reference, discloses a process for making reduced iron including pelletizing a mixture of powdered iron ore and coal and reducing iron oxide in a hot atmosphere. This process has some advantages: use of coal as a reducing agent, direct use of powdered ore, a high reducing rate, and ready control of the carbon content in a product.

In this process, a given amount or depth of pellets or briquettes of iron oxide agglomerates incorporated with a carbonaceous material (hereinafter referred to as simply "agglomerates") is fed into a moving hearth reducing furnace, such as a rotary hearth furnace. The contents are moved and heated by radiant heat in the furnace. Thus, iron oxide is reduced with the incorporated carbonaceous material to form reduced iron. The reduced iron is discharged from the moving hearth of the furnace by a screw of a discharging apparatus. The process of U.S. Pat. No. 3,443,931 is shown in FIG. 12. In FIG. 12, the screw 1 of the discharging apparatus is supported by an elevator 3 and a bearing 4, comes into contact with a moving hearth 2 by its own weight, and rotates to discharge the reduced iron from a discharging port 25.

When the agglomerates are fed into the moving hearth furnace, parts of the agglomerates are pulverized by rolling, friction or dropping shock and the iron oxide powder is deposited on the moving hearth. As shown in FIG. 13, the iron oxide powder moves towards the screw 1 and is reduced to metallic iron powder 26. The metallic iron powder on the rotating hearth is squeezed into the furnace face by the screw and is deformed to elongated metal powder 28 (see "Initial Forming Stage of Iron Sheet" in FIG. 13). The elongated metal powder 28 squeezed into the furnace is barely oxidized in a reducing atmosphere. Thus, the elongated metal powder gradually grows by the pressure of the screw 1 and becomes an iron sheet (see "Iron Sheet Forming Stage" in FIG. 13).

In a hearth surface of the rotary hearth furnace, there is a temperature difference of at least 300° C. between the heating and reducing region and the feeding region in the furnace. This temperature difference is transferred to the iron sheet 29 by the rotation of the rotary hearth, and thus the iron sheet 29 repeatedly expands and shrinks. As a result, cracks form in the iron sheet 29. When pressure by the screw 1 is applied to the cracks of the iron sheet 29, a warp forms in the iron sheet 29. The iron sheet 29 having a large warp catches on the screw 1 and is detached from the hearth (see "Detachment of Iron Sheet" in FIG. 13). A grown detached iron sheet 29 inhibits discharge of reduced iron 10 by the screw 1 and causes problems such as shutdown (see "Shutdown due to Detachment of Iron" in FIG. 13).

Furthermore, pits are formed on the moving heath during the formation and detachment of the iron sheet. Since the agglomerates are deposited on the pits, the depth of the fed agglomerates is not stable, and the agglomerates are not uniformly heated. Accordingly, the quality of the reduced iron is deteriorated.

SUMMARY OF THE INVENTION

Accordingly, it is an object of the present invention to provide a method for operating a moving hearth reducing furnace for reducing iron oxide agglomerates incorporated with a carbonaceous material, which method does not substantially form an iron sheet on a moving hearth, remove iron oxide powder from the agglomerates, and enables continuous stable operation.

A method for operating a moving hearth reducing furnace in accordance with the present invention includes feeding iron oxide agglomerates incorporated with a carbonaceous material onto a moving hearth of a moving hearth reducing furnace, reducing the iron oxide agglomerates to form reduced iron agglomerates, and providing a gap between a discharging apparatus for discharging the reduced iron agglomerates from the moving hearth reducing furnace and the surface of the moving hearth.

Since metallic iron powder formed by reduction of the iron oxide agglomerate is not squeezed into the surface of the moving heath, no iron sheet is formed. An iron oxide layer formed on the moving hearth can be easily scraped off to renew the surface of the moving hearth so that the furnace can be continuously operated.

Preferably, the discharging apparatus is raised continuously or intermittently from the surface of the moving hearth in response to the thickness of an iron oxide layer formed on the moving hearth by oxidation of iron oxide powder included in the iron oxide agglomerates.

Since the iron oxide powder deposited on the iron oxide layer is not squeezed into the iron oxide layer, no iron sheet is formed.

Preferably, the discharging apparatus is brought into contact with the iron oxide powder deposited on the iron oxide layer on the moving hearth or metallic iron powder formed by reduction of the iron oxide powder, during the operation.

Preferably, the amount of the iron oxide powder fed with the iron oxide agglomerates into the moving hearth reducing furnace per unit time is determined, the amount of metallic iron powder formed by reduction of the iron oxide powder is determined, the amount of the metallic iron powder is converted to a volume A, and the discharging apparatus is raised so that the ratio A/B is 50 or less, wherein B is the spatial volume defined by the product of the increment of the height of the discharging apparatus and the area of the moving hearth. Preferably, a gap is provided between the discharging apparatus and the surface of the moving hearth or the iron oxide layer and the gap is ¾ or less the average diameter of the iron oxide agglomerates.

Preferably, the iron oxide layer on the moving hearth is periodically scraped off. Preferably, the surface of the iron oxide layer is preliminarily oxidized using an oxidizing burner and is scraped off by a vertically movable cutter provided behind the oxidizing burner.

Preferably, iron oxide powder included in the iron oxide agglomerates, metallic iron powder formed by reduction of the iron oxide powder, and metallic iron powder formed when the reduced iron is discharged from the furnace are evacuated together with exhaust gas through a duct provided in the vicinity of the discharging apparatus and a feeder for feeding the iron oxide agglomerates.

Preferably, the reduced iron agglomerates, metallic iron powder formed by reduction of iron oxide powder included in the iron oxide agglomerates, and metallic iron powder formed when the reduced iron is discharged from the furnace are simultaneously discharged from the furnace through the discharging apparatus.

Preferably, the discharging apparatus is a header blowing an inert gas or a reducing gas, and the reduced iron agglomerates and the metallic iron powder are simultaneously discharged from the moving hearth reducing furnace by blowing the inert or reducing gas in the radial direction of the moving hearth reducing furnace through the header.

Preferably, the discharging apparatus is an electromagnet unit which reciprocally moves in the radial direction of the moving hearth reducing furnace, and which attracts and discharges simultaneously the reduced iron agglomerates and the metallic iron powder from the moving hearth reducing furnace.

Preferably, iron oxide powder included in the iron oxide agglomerates, metallic iron powder formed by reduction of the iron oxide powder, and metallic iron powder formed when the reduced iron is discharged from the furnace are evacuated together with exhaust gas through a duct provided in the vicinity of the discharging apparatus and a feeder for feeding the iron oxide agglomerates. Since the formation of the iron oxide layer and an iron sheet on the moving hearth is suppressed, the furnace can be continuously operated and reduced iron having a high metal content can be produced.

DESCRIPTION OF THE PREFERRED EMBODIMENTS

The preferred embodiments of the present invention will be described with reference to FIGS. 1 to 11.

Figure 1:
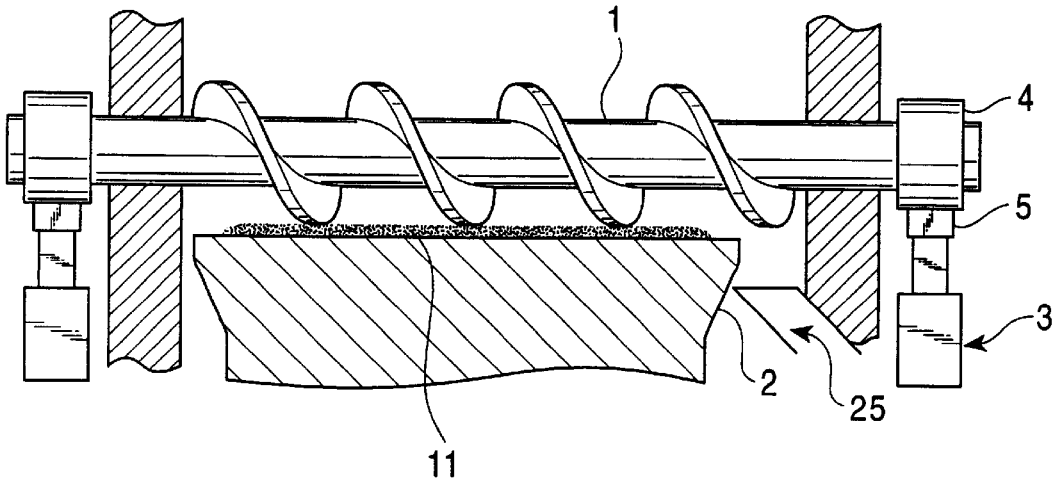
FIG. 1 is a cross-sectional view of a screw of a discharging apparatus in accordance with the present invention.

With reference to FIG. 1, in the operation of a moving hearth reducing furnace in accordance with the present invention, a gap is provided between a screw 1 for discharging reduced iron agglomerates towards an outlet 25 and the surface of a moving hearth 2. Iron oxide powder 11, which is fed together with iron oxide agglomerates and is deposited on the moving hearth 2, is not squeezed into the moving hearth 2 by the tip of the screw 1. Thus, no iron sheet is formed on the moving hearth 2. An elevator 3 and a bearing 4 support the screw 1. The screw 1 has a load cell 5 for detecting contact of the screw 1 with the moving hearth 2.

Figure 3:
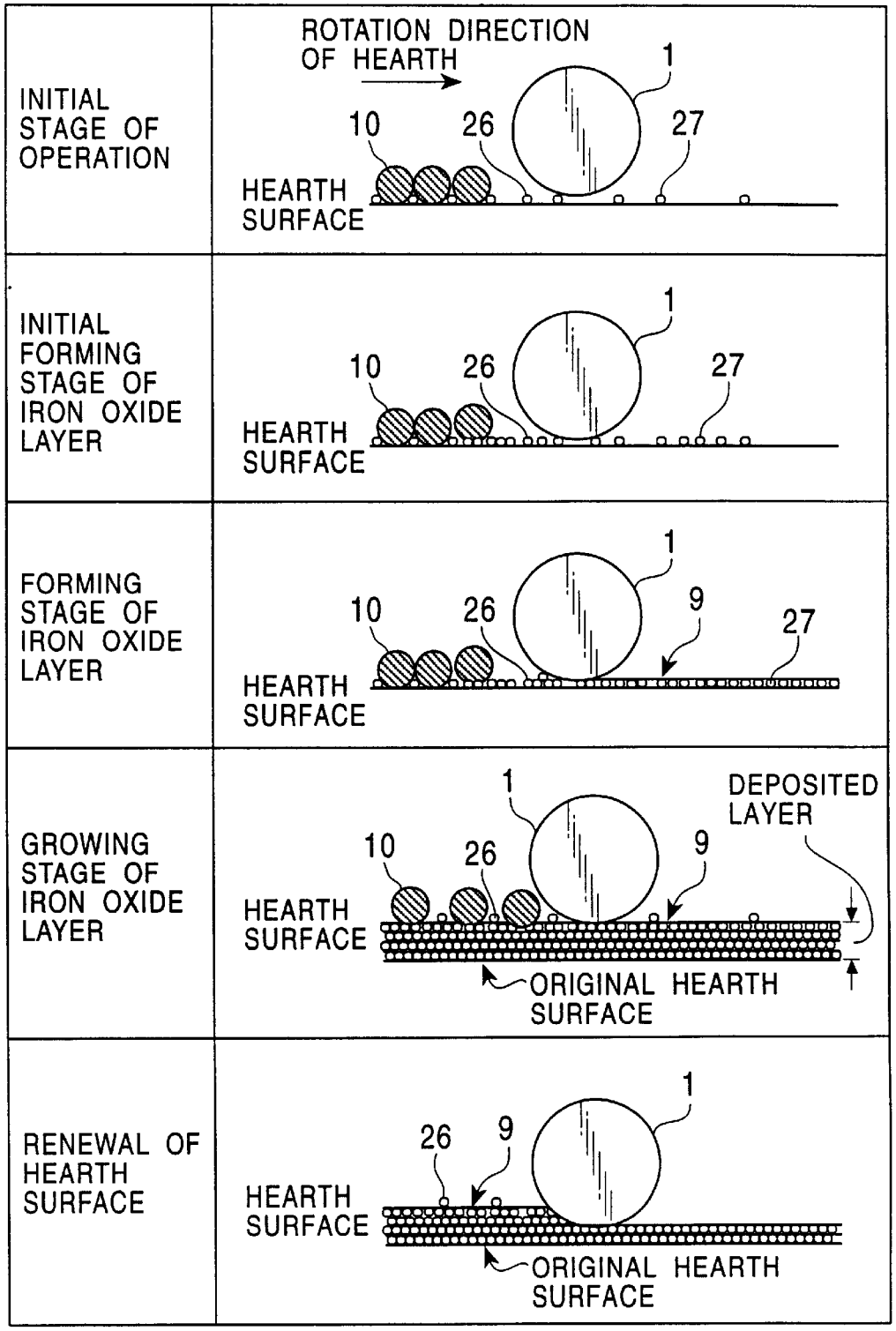
FIG. 3 is a schematic view of a forming process of an iron oxide layer and a method for scraping the same.

With reference to FIG. 3, the iron oxide powder 11 deposited on the moving hearth 2 is reduced to form metallic iron powder 26, and is then reoxidized in the furnace to form an iron oxide layer 9 on the moving hearth. The height of the screw 1 is continuously or intermittently adjusted in response to the depth of the iron oxide layer 9 so that the iron oxide powder 11 is not squeeze into the iron oxide layer 9 by the screw 1. Accordingly, no iron plate is formed.

When the operation is continued with the iron oxide layer 9 formed on the moving hearth remaining, metallic iron powder 26 and iron oxide 27 on the moving hearth 2 increase and cause an increase in thickness of the porous iron oxide layer 9. The metallic iron powder 26 and the iron oxide 27 come into contact with the screw 1 and are squeezed into pores of the porous iron oxide layer 9. Since the level of the screw 1 is adjusted to an upper position, the porous iron oxide layer 9 does not form an iron sheet.

The level of the screw 1 may be adjusted in response to the volume of the iron oxide powder 11 fed into the moving hearth reducing furnace. That is, the weight of the iron oxide powder 11 included in the furnace per unit time is calculated from the ratio of the iron oxide powder 11 to the fed agglomerates, the weight of the metallic iron powder 26 formed by reduction is determined from the weight of the iron oxide powder 11 in view of data from past operations, and finally the weight of the metallic iron powder 26 is converted to a volume A by the bulk density thereof. On the other hand, the product of the increment of the level of the screw 1 and the hearth area is defined as the spatial volume B. The screw 1 is raised within the unit time so that the ratio A/B is 50 or less. With respect to the ratio of the iron oxide powder 11 to the agglomerates, the data of the past operation may be used.

When the ratio A/B is larger than 50, a sufficient gap is not maintained between the screw 1 and the moving hearth 2. Thus, the formed iron oxide layer 9 will readily come into contact with the screw 1 and the iron oxide powder will be tightly squeezed into the iron oxide layer 9. As a result, an iron sheet will be formed on the iron oxide layer 9. It is preferable that the ratio A/B be 20 or less in order to more securely avoid the contact of the iron oxide layer 9 formed on the moving hearth 2 with the screw 1.

Alternatively, the level of the screw 1 may be adjusted so that the gap between the screw 1 and the surface of the moving hearth 2 or the iron oxide layer 9 is ¾ or less the average diameter of the agglomerates. This level also can prevent squeezing the iron oxide powder 11 into the iron oxide layer 9 and thus the formation of the iron sheet. At a ratio of more than ¾, the screw 1 inhibits discharge of the reduced iron 10. Furthermore, the gap is set so that the iron oxide powder 11 can pass therethrough.

As described above, the gap between the screw 1 and the surface of the moving hearth is adjusted in response to the volume of the iron oxide powder 11 of the agglomerate. Since the metallic iron powder 26 is not squeezed into the iron oxide layer 9, no iron sheet is formed.

When the operation is further continued while adjusting the gap between the screw 1 and the surface of the moving hearth 2, the iron oxide powder 11 included in the fed agglomerates causes a gradual increase in thickness of the iron oxide layer 9 on the moving hearth 2. The iron oxide layer 9 must be removed before occurrence of operational hindrance. Since the iron oxide layer 9 is porous, it can be scraped using a cutter. Furthermore, the porous iron oxide layer 9 is detached from the surface of the moving hearth 2 as small lumps. Thus, the furnace can be stably and continuously operated.

Figure 2:
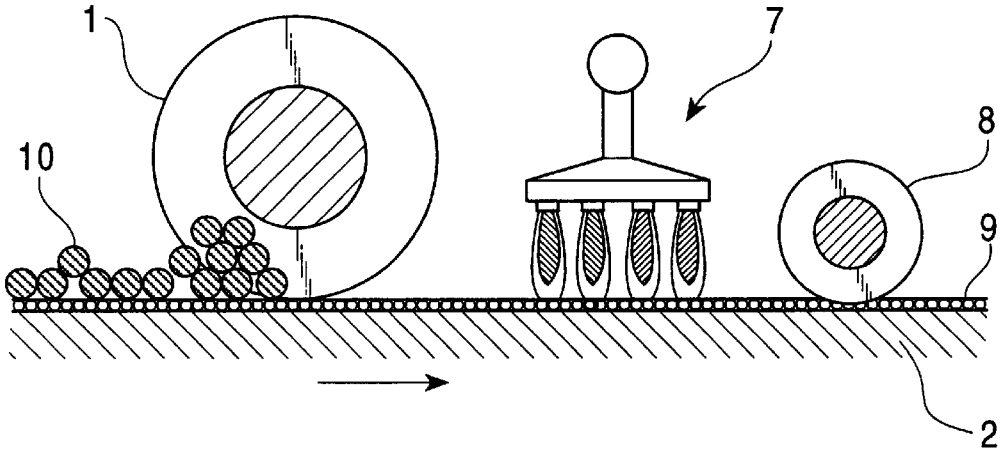
FIG. 2 is a schematic view of a method for scraping the iron oxide layer off a moving hearth in accordance with the present invention.

Preferably, the porous iron oxide layer 9 on the moving hearth 2 is periodically scraped off so that the surface of the moving hearth 2 is renewed. This process enables continuous operation of the furnace without maintenance of the moving hearth 2. With reference to FIG. 2, the surface of the porous iron oxide layer 9 may be preliminarily oxidized using an oxidizing burner 7 ($Fe \rightarrow FeO$, $FeO \rightarrow Fe_2O_3$) so that a vertically movable cutter 8 provided behind the oxidizing burner 7 can scrape the iron oxide layer 9. Such oxidation may be performed in an oxidizing atmosphere which will be formed by suspending the supply of the agglomerates, or using the oxidizing burner 7 provided downstream of the screw 1, as shown in FIG. 2. Since the oxidizing burner 7 can locally oxidize the surface, the cutter 9 can continuously scrape off the iron oxide layer 9 during the operation.

The surface of the moving hearth 2 may also be scraped off by the cutter 8 within an allowable range to remove pits and cracks formed on the moving hearth 2 during the operation. This process can prolong the operation term of the furnace until the next maintenance of the moving furnace 2, and can produce reduced iron of uniform quality. The period for shaving is determined in view of the scale of the facility and the operational conditions so that the furnace is operated continuously.

Figure 4:
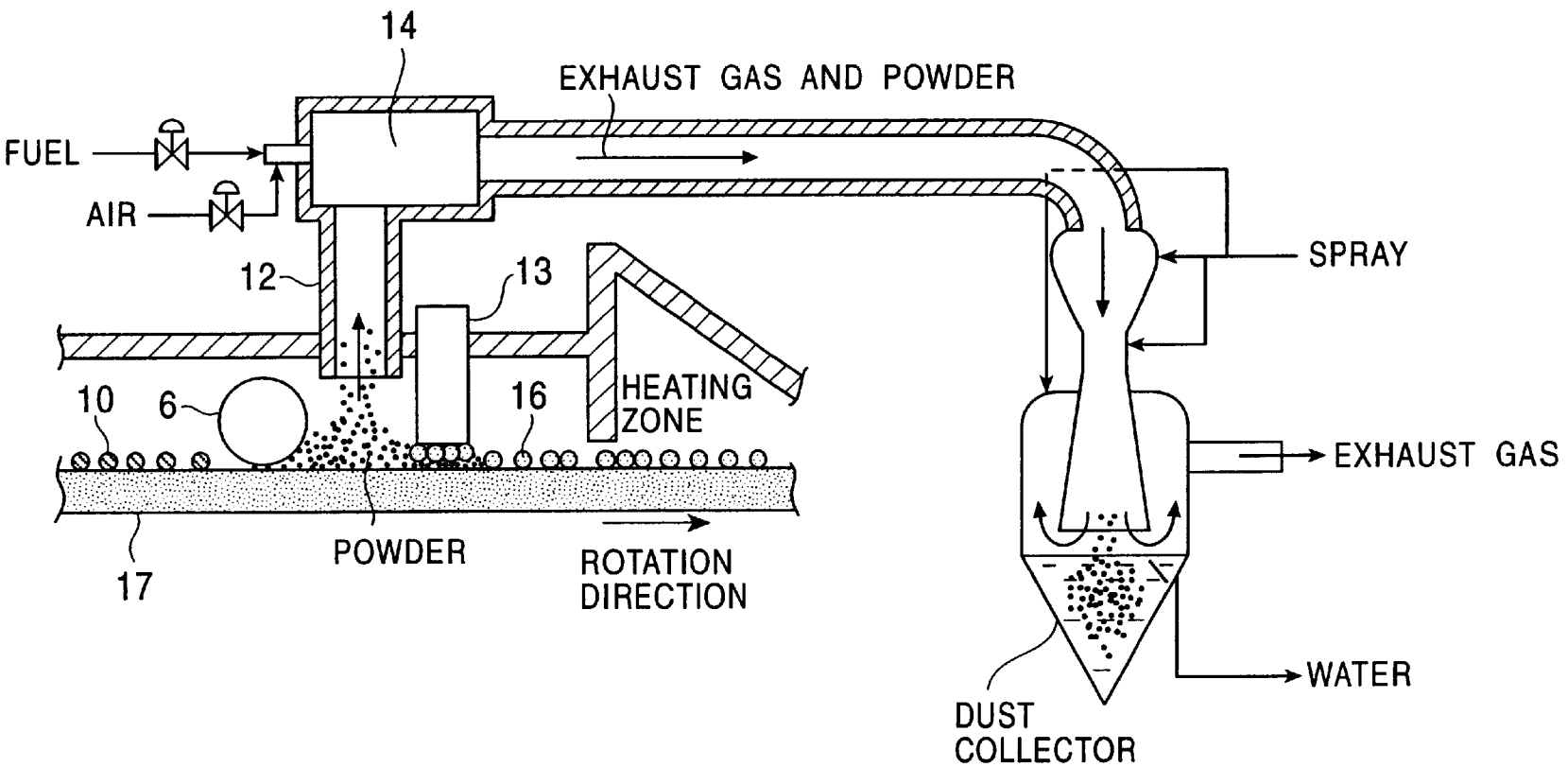
FIG. 4 is a cross-sectional view of an apparatus for discharging powder, which is formed during feeding a raw material and during discharging a reduced product, through an exhaust gas line.

With reference to FIG. 4, the iron oxide powder 11, metallic iron powder 26 formed by reduction of the iron oxide powder 11, and powder formed when the reduced iron is discharged from the furnace are evacuated together with the exhaust gas through a duct provided in the vicinity of the screw and a feeder 13 for agglomerates. Since the iron oxide powder 11 is not deposited on the moving hearth 2, no iron oxide layer or no iron sheet is formed in the furnace, resulting in stable and continuous operation.

Figure 8A:
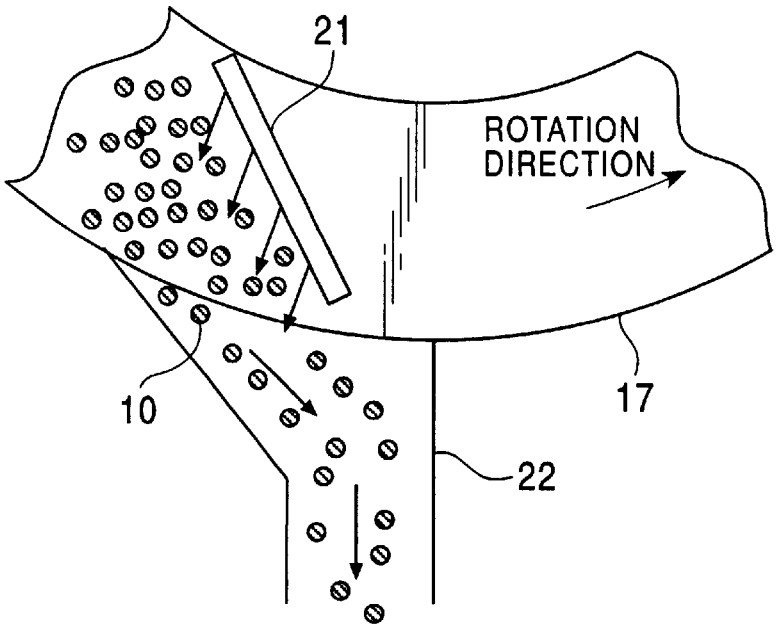
FIGS. 8A and 8B are a transverse cross-sectional view and a longitudinal cross-sectional view, respectively, of a rotary hearth furnace provided with a discharging apparatus for discharging reduced agglomerates by an inert or reducing gas blown from a header.
Figure 8B:
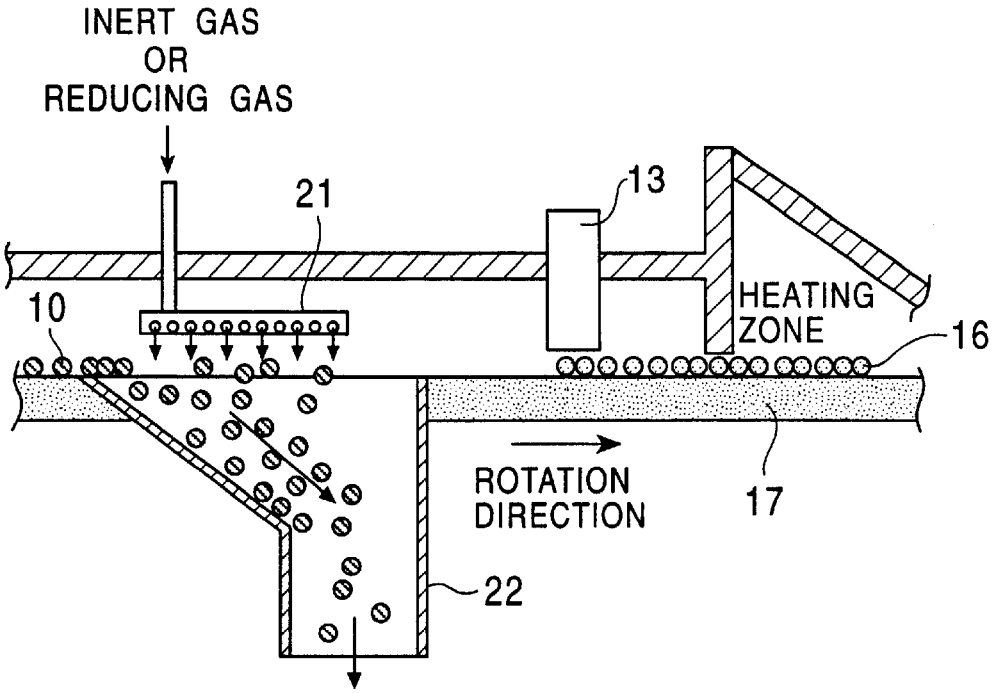
Figure 9A:
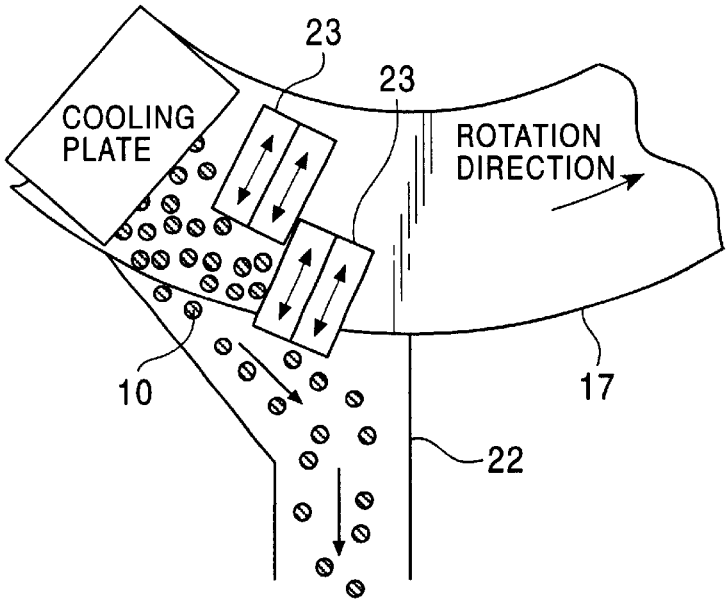
FIGS. 9A and 9B are a transverse cross-sectional view and a longitudinal cross-sectional view, respectively, of a rotary hearth furnace provided with a discharging apparatus for discharging reduced agglomerates by attracting the reduced agglomerates using an electromagnet.
Figure 9B:
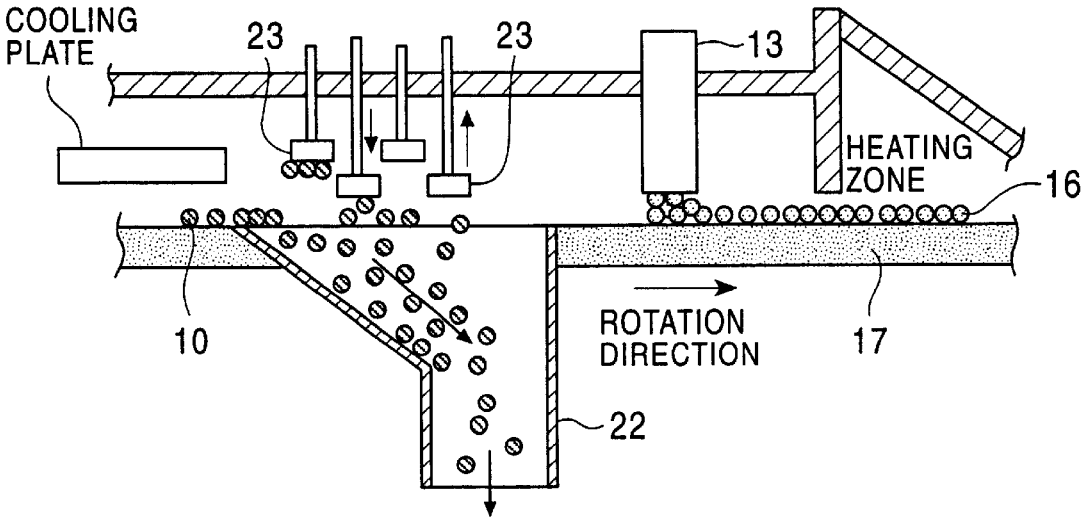

The reduced iron 10 may be discharged from the furnace by an inert or reducing gas blown through a header 21, as shown in FIGS. 8A and 8B, or by being attracted with an electromagnet 23, as shown in FIGS. 9A and 9B. In this process, the iron oxide powder 11 fed into the furnace and the metallic iron powder 26 formed by reduction of the iron oxide powder 11 are also discharged from the furnace. Thus, no iron oxide layer or no iron sheet is formed on the moving furnace 2, resulting in stable and continuous operation.

Preferably, the iron oxide powder 11 is removed before the agglomerates are fed into the moving hearth reducing furnace. Since the iron oxide powder 11 is not fed into the furnace, the formation of the iron oxide layer 9 and the iron sheet on the moving hearth will be suppressed, resulting in stable and continuous operation.

The present invention will be described in more detail with reference to the following Examples using rotary hearth furnaces.

EXAMPLE 1

Table 1 shows operations in which a discharging apparatus, that is, a screw 1, was continuously adjusted upwardly. Agglomerates having particle sizes of 14 to 20 mm and an average particle size of 18 mm were reduced in a moving hearth reducing furnace. The screw 1 was raised at a rate of 1 mm per 72 hours for Run 1 in accordance with the present invention, 1 mm per 24 hours for Run 2 in accordance with the present invention, and 1 mm per 12 hours for Run 3 in accordance with the present invention, as shown in Table 1. In Comparative Runs 1 and 2, the screw 1 was not raised from the moving hearth 2 during the operation.

Upward adjustment of the screw 1 in Run 1 will now be described. In Run 1, reduced iron was produced at a rate of 2 tons/hour while agglomerates were fed at a rate of 2.8 tons/hour. If the percentage of the iron oxide powder 11 is supposed to be 1.5%, the rate fed in the furnace is 0.042 tons/hour and thus 3 tons of iron oxide powder is fed into the furnace over 72 hours. If 72% of the iron oxide powder 11 is reduced to metallic iron powder 26, 2.16 tons of metallic iron powder 26 is produced. When the bulk density of the metallic iron powder 26 is 5 tons/$m^3$, the volume A of the metallic iron powder 26 becomes 0.432 $m^3$. On the other hand, the moving hearth reducing furnace has a hearth area of 28.5 $m^2$, and the screw 1 is raised at a rate of 1 mm per 72 hours. Thus, the spatial volume B becomes 0.0285 $m^3$. The ratio A/B is 15.2 and lies in the preferable range (20 or less) in the present invention.

Since the screw was raised in Runs 1 to 3 in accordance with the present invention, an iron oxide layer 9 was formed on the moving hearth, the screw 1 squeezed a very small amount of metallic iron powder 26 into the moving hearth 2, and no iron sheet was formed. The moving hearth 2 had small number of pits on the surface and thus had high smoothness after operation for 100 hours. As a result, the furnace was continuously operated for 250 hours. Since the amount of the metallic iron powder 26 discharged by the screw 1 was small, the reduced iron 10 contained 0 to 6% of metallic iron powder 26 having a particle diameter of 3 mm or less.

In Comparative Run 1, the screw 1 squeezed the metallic iron powder 26 into the surface of the moving hearth to form an iron sheet. Thus, smoothness of the surface of the moving hearth 2 was deteriorated. As a result, a continuous operation over 150 hours was not performed. Since the moving hearth 2 was composed of $FeO.SiO_2$ which softens at high temperature, an iron sheet was detached from a large area of the moving hearth 2. Thus, the moving hearth 2 required maintenance after operation for 24 hours. In Comparative Runs 1 and 2, a large amount of metallic iron powder 26 was discharged by the screw 1, and the discharged reduced iron 10 contained 8 to 18% of metallic iron powder 26 having particle sizes of 3 mm or less.

In Table 1, the smoothness (%) of the moving hearth 2 er operation for 100 hours was defined as {(overall area−area of pits)/(overall area)}×100.

TABLE 1

| | Raising Rate (h/mm) of Screw | Hearth Material | Productivity ($kg/m^2/h$) | Metal Rate (%) in Reduced Iron Agglomerates | Rate (%) of Metallic iron powder (≦3 mm) in Reduced Iron Agglomerates | Smoothness after Operation for 100 hours | Operation Time (h) |
|---|---|---|---|---|---|---|---|
| Run 1 | 72 | Iron Ore | 75 | 90 to 95 | 0 to 5 | 96 | ≧250 |
| Run 2 | 24 | Iron Ore | 80 | 89 to 94 | 0 to 5 | 95 | ≧250 |
| Run 3 | 12 | Iron Ore | 100 | 88 to 93 | 0 to 6 | 98 | ≧250 |
| Comparative Run 1 | 0 | Iron Ore | 80 | 79 to 88 | 10 to 18 | 40 to 60 | 150 |
| Comparative Run 2 | 0 | $FeO \cdot SiO_2$ | 80 | 85 to 93 | 8 to 16 | 0 | 24 |

EXAMPLE 2

The furnace was operated while adjusting upwardly the level of the screw and the iron oxide layer formed on the moving hearth was periodically scraped off.

With reference to FIG. 3, at the initial stage of the operation, metallic iron powder 26 formed by reduction of the iron oxide powder included in agglomerates fed into the furnace, iron oxide 27 formed by oxidation of the metallic iron powder 26, and unreduced iron oxide 27 lay on the moving hearth 2. The metallic iron powder 26 and the unreduced iron oxide 27 increased during the operation, and then a porous iron oxide layer 9 containing the metallic iron powder 26 was formed on the moving hearth 2 (see Initial Forming Stage of Iron Oxide Layer). Next, the screw 1 came into contact with the metallic iron powder 26 and squeezed it into pores in the iron oxide layer 9. Since gangue was not separated from the metallic iron powder 26, powder iron metal 26 was not combined and iron sheet was not formed (see Forming Stage of Iron Oxide Layer). The screw 1 was raised during the subsequent operation to form a new gap between the screw 1 and the iron oxide layer 9. Thus, the iron oxide layer 9 grew (see Growing Stage of Iron Oxide Layer). As shown in Table 2, the operation was continued until the thickness of the iron oxide layer 9 reached 30 mm. Next, the surface of the iron oxide layer 9 was heated and oxidized in an oxidizing atmosphere. The 3-mm surface of the iron oxide layer 9 was thereby oxidized and cracks were formed on the surface of the iron oxide layer 9. The 3-mm surface layer was scraped off by a screw 1 after the rotary hearth rotated by one turn (see Renewal of Hearth Surface). The oxidation and shaving were repeated to completely remove the iron oxide layer 9 having a thickness of 30 mm on the moving hearth. The working time shown in Table 2 includes the times required for heating and oxidizing the surface of the iron oxide layer 9.

TABLE 2

| | |
|---|---|
| Scraping Depth (mm) | 30 |
| Operated Time when scraping is performed (h) | 420 |
| Time required for scraping (min) | 120 |
| Rate (%) of Metallic iron powder in Reduced Iron Agglomerates | 89 to 96% |

As shown in FIG. 2, the surface was oxidized using an oxidizing burner 7 and the iron oxide layer 9 was scraped off using a cutter 8. The results are shown in Table 3.

TABLE 3

| | |
|---|---|
| Scraping Depth (mm) | 5 |
| Operated Time when Scraping is performed (h) | 75 |
| Time required for Scraping (min) | 60 |
| Rate (%) of Metallic iron powder in Reduced Iron Agglomerates | 89 to 96% |

As shown in Table 3, the 5-mm iron oxide layer 9 was scraped off after 75 hours of the operation. In the 60 minutes required for scraping, 30 minutes was used for preliminary operations. Thus, the 5-mm iron oxide layer 9 was scraped during the rotary hearth rotated by three turns. The iron oxide layer 9 was locally oxidized by the oxidizing burner 7 and was scraped off without shutdown.

The surface of the moving hearth was thereby renewed and stable operation was continued.

EXAMPLE 3

A duct for exhaust gas was provided in the vicinity of the discharging apparatus of the reduced iron and the feeder of the agglomerates to evacuate the iron oxide powder fed with the agglomerates and reduced iron powder formed by the reduction stage and the discharging stage, as well as the exhaust gas.

With reference to FIG. 4, a duct 12 for evacuating exhaust gas was provided between a discharging apparatus 6 and a feeder 13 of a rotary hearth furnace. The iron oxide powder 11 of agglomerates and the powder formed from reduced iron 10 in the reduction stage and the discharging stage were evacuated together with the exhaust gas through the duct 12, and the exhaust gas was burned in a combustion chamber 14. The burned exhaust gas and the powder were cooled in a gas cooler and separated. The powder was collected in a dust collector.

As described above, the powder was not deposited on the moving hearth 2, and thus, no iron oxide layer nor iron sheet was formed on the moving hearth.

Figure 10:
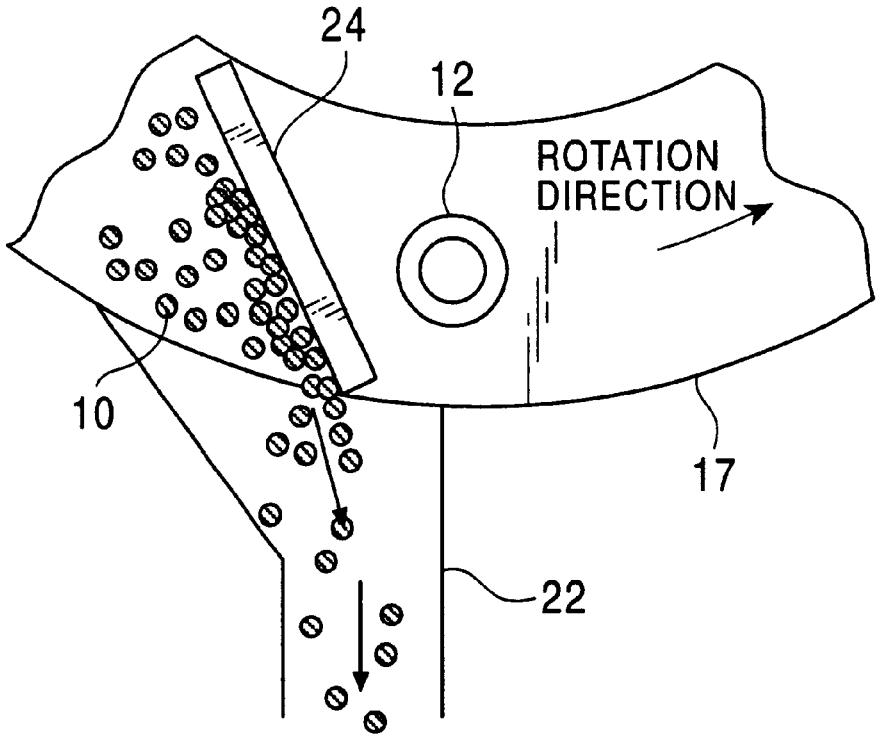
FIG. 10 is a transverse cross-sectional view of a rotary hearth furnace provided with a discharging apparatus for discharging reduced agglomerates using a vertically movable plate.
Figure 11:
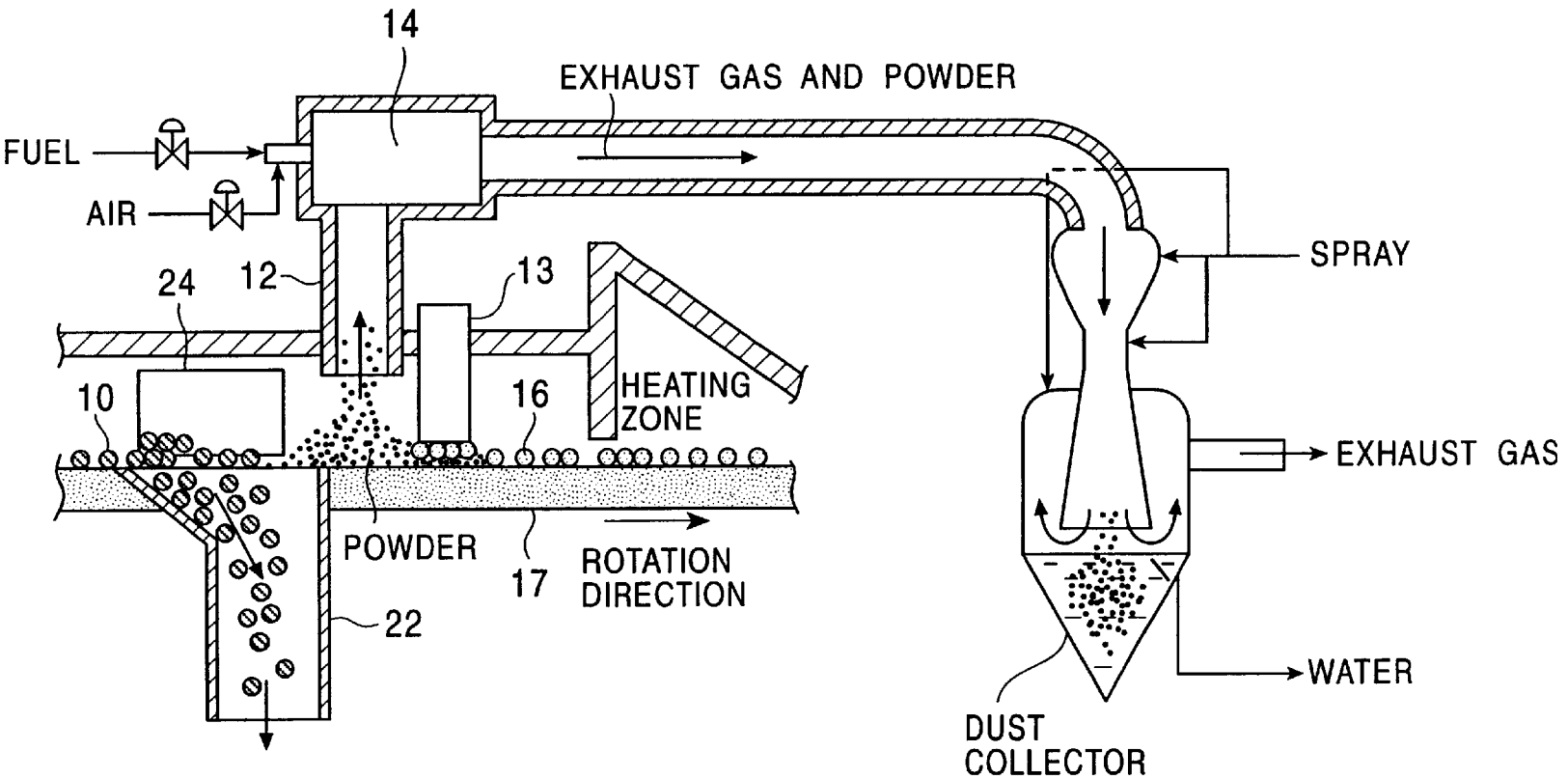
FIG. 11 is a transverse cross-sectional view of a rotary hearth furnace provided with a discharging apparatus for discharging reduced agglomerates using a vertically movable plate.
Figure 12:
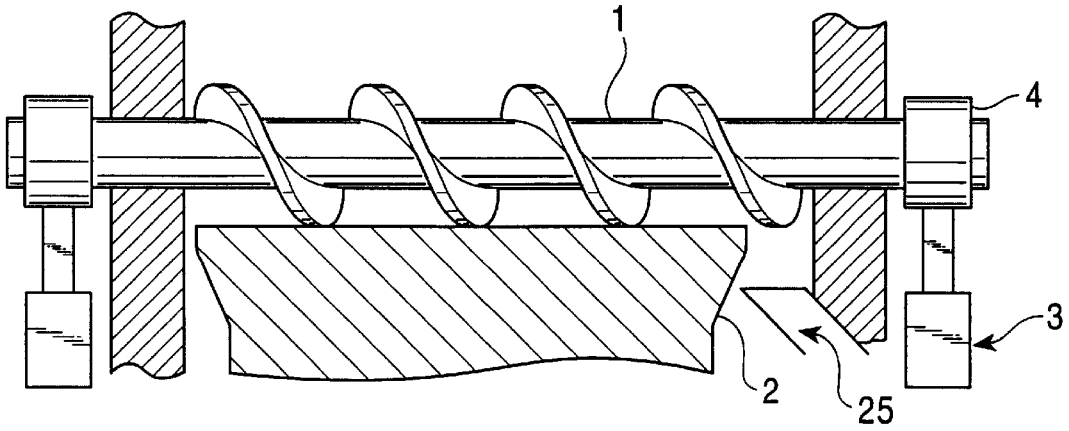
FIG. 12 PRIOR ART
FIG. 12 is a schematic cross-sectional view of a screw of a conventional discharging apparatus.
Figure 13:
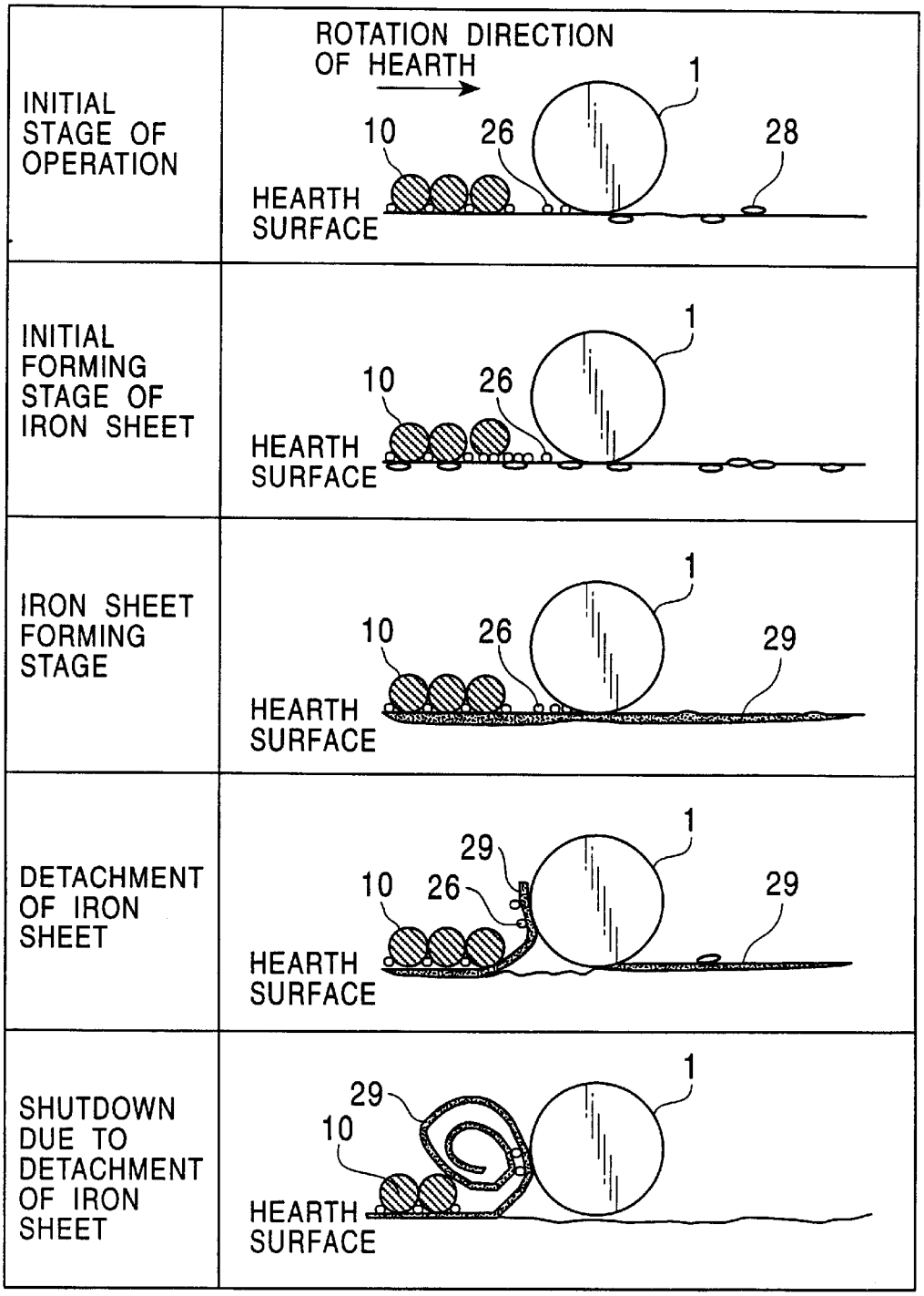
FIG. 13 PRIOR ART
FIG. 13 is a schematic view for illustrating a process for forming an iron sheet on a moving hearth in a conventional technology.

In this example, the discharging apparatus may be the screw 1 used in Examples 1 and 2, or a discharging board 24 shown in FIG. 10 or 11.

EXAMPLE 4

Prior to feeding iron oxide agglomerates incorporated with a carbonaceous material into a moving hearth reducing furnace, the iron oxide powder was removed.

Figure 5:
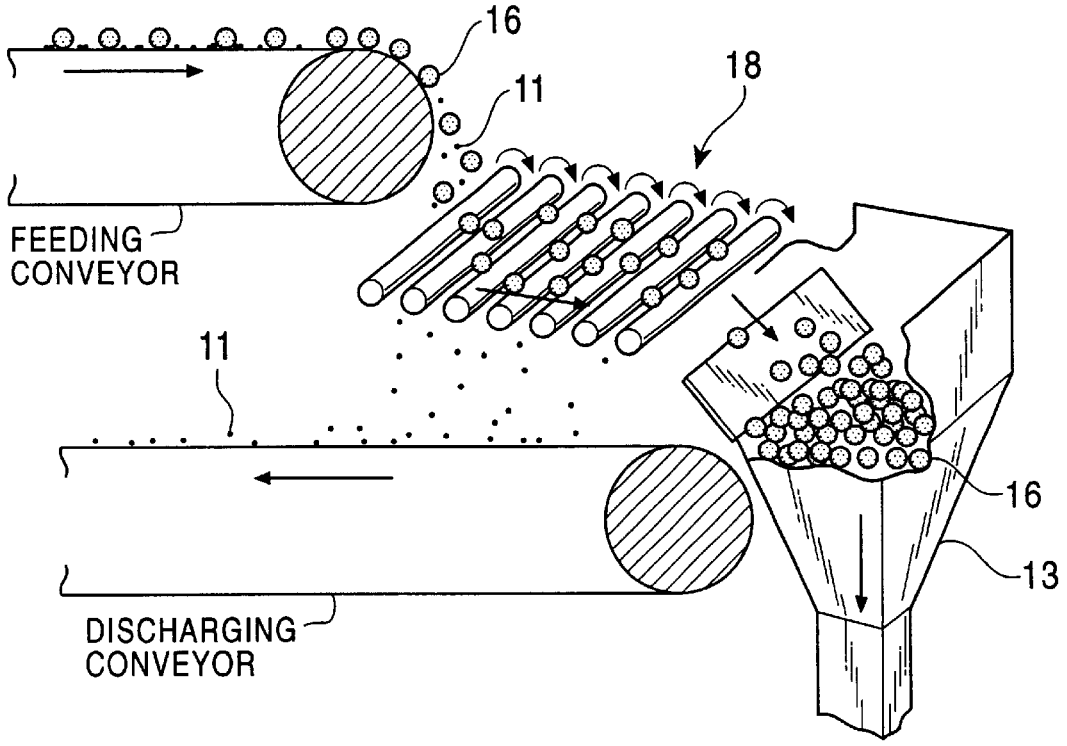
FIG. 5 is a schematic view for illustrating removal of iron oxide powder from agglomerates using a roller screen.

With reference to FIG. 5, agglomerates 16 with iron oxide powder 11 were fed from a feeding conveyor onto a roller screen 18. The iron oxide powder 11 dropped on an exhaust conveyer through gaps of the roller screen 18, while the agglomerates 16 traveled on the roller screen and were fed into the moving hearth reducing furnace through a feeder 13.

Figure 6A:
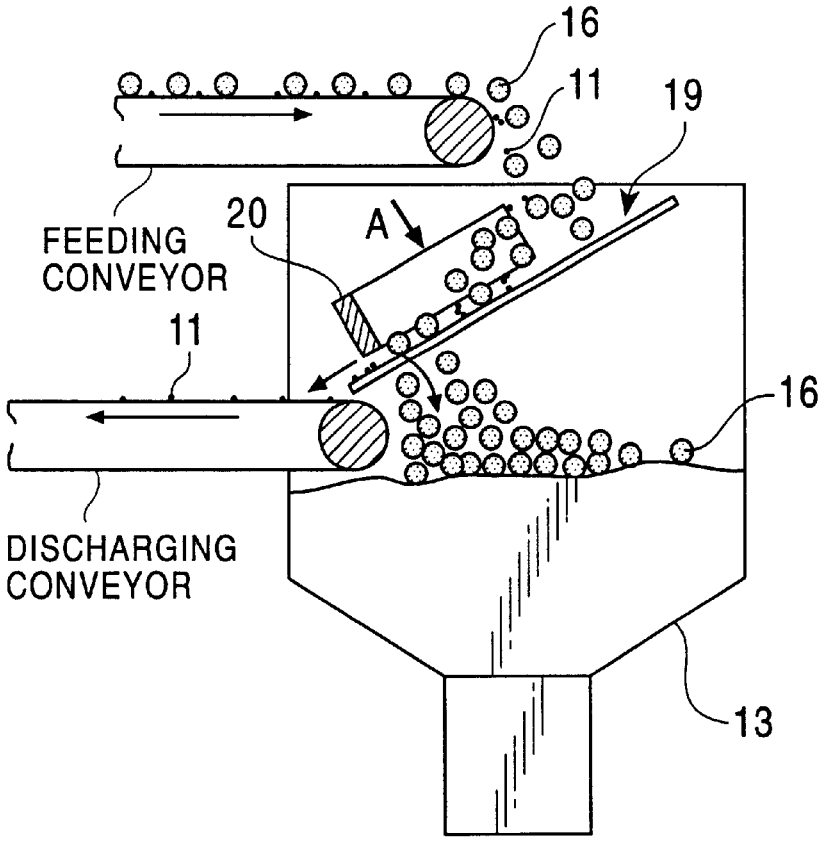
FIGS. 6A and 6B are a front view partly in section and a partial cross-sectional view, respectively, for illustrating removal of iron oxide powder from agglomerates using an inclined separator.
Figure 6B:
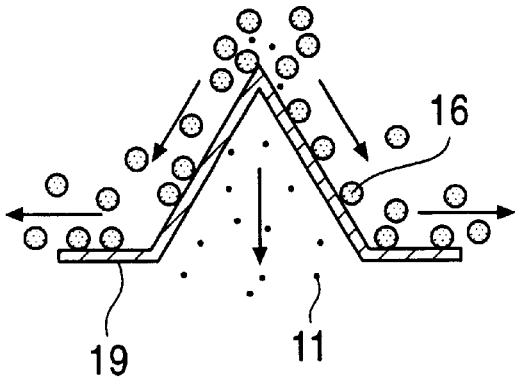

FIG. 6A is a front view, partly in section, illustrating removal of the iron oxide powder 11 from the agglomerates 16 using a separator 20, and FIG. 6B is a partial cross-sectional view of the separator 20 along the arrow A in FIG. 6A. A gap is provided between a slope 19 and a separator 20. The iron oxide powder included in the agglomerates 16 can pass through the gap. The agglomerates 16 and the iron oxide powder 11 are fed onto the separator 20, that is, the top of the chevron face shown in FIG. 6B. The agglomerates 16 drop along the separator 20 and are fed into the feeder 13, whereas the iron oxide powder 11 passes through the separator 20 and the gap and are removed by an exhaust conveyor. The slope 19 is preferably vibrated so that the iron oxide powder 11 is not deposited on the slope 19.

Figure 7:
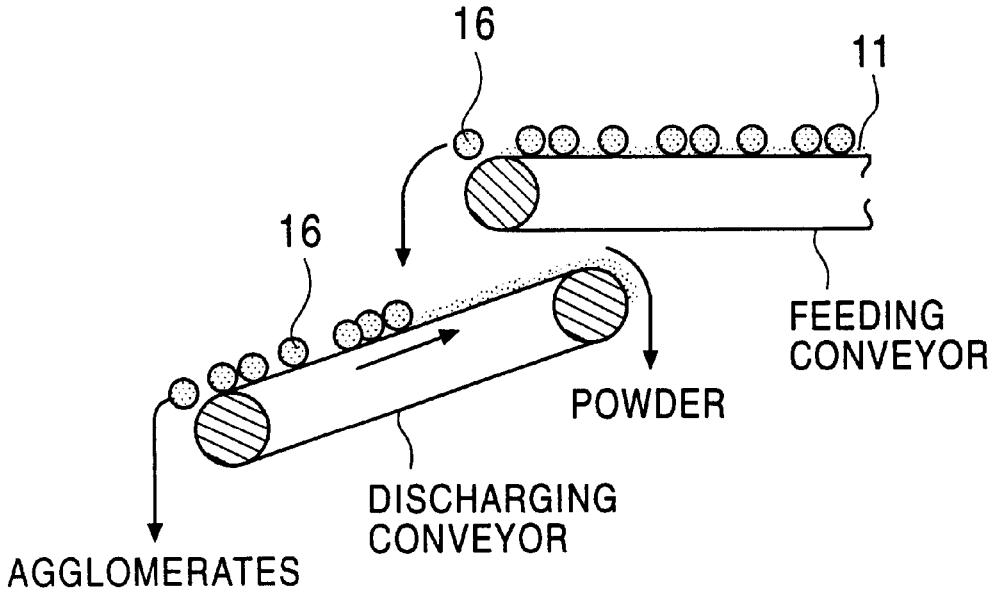
FIG. 7 is a schematic view for illustrating removal of iron oxide powder from agglomerates using an angle of repose of the powder.

FIG. 7 shows removal of the iron oxide powder 11 from the agglomerates 16 using a feeding conveyor and an exhaust conveyor. The exhaust conveyor is slanted in this case. The agglomerates 16 with the iron oxide powder 11 are fed onto the feeding conveyor. The agglomerates 16 and the iron oxide powder 11 drop on the slanted exhaust conveyor. The agglomerates 16 roll down the exhaust conveyor in the direction opposite to the moving direction, while the iron oxide powder 11 is carried in the moving direction. The inclination angle of the slanted exhaust conveyor is determined by the angle of repose of the iron oxide powder 11. At the optimized angle, the agglomerates roll down the exhaust conveyor but the iron oxide powder does not roll down.

EXAMPLE 5

Reduced iron from iron oxide agglomerates and metallic iron powder from iron oxide powder were simultaneously discharged from a moving hearth reducing furnace.

FIG. 8A is a transverse cross-sectional view of a discharging apparatus for discharging reduced iron agglomerates 10 by an inert gas or a reducing gas blown from a header 21, and FIG. 8B is a longitudinal cross-sectional view thereof. An inert gas or a reducing gas from nozzles of a header 21 blows off the reduced iron agglomerates 10 and metallic iron powder 26 on the rotary hearth towards a discharging chute 22. Any gas not oxidizing iron at a temperature of 1,000 to 1,200° C. may be used. A typical inert gas is nitrogen and a typical reducing gas is methane.

FIG. 9A is a transverse cross-sectional view of a discharging apparatus which discharges reduced iron 10 by attracting the reduced iron 10 using an electromagnet unit 23, and FIG. 9B is a longitudinal cross-sectional view of the discharging apparatus. The electromagnet unit 23 consists of two pairs of electromagnets, one pair is provided at the inner side of the discharging apparatus and the other pair is provided at the outer side of the apparatus. Each pair can be moved vertically. The inner electromagnets attract the reduced iron 10 and metallic iron powder 26 and transfer these to the center of a rotary hearth 17. The outer electromagnets attract the reduced iron 10 and the metallic iron powder 26 in the center, transfer these to the discharging chute 22, and discharge these into the discharging chute 22. The reduced iron 10 and the metallic iron powder 26 are, thereby, simultaneously discharged.

What is claimed is:

1. A method for operating a moving hearth reducing furnace, the method comprising:

feeding iron oxide agglomerates incorporated with a carbonaceous material onto a moving hearth of a moving hearth reducing furnace;

reducing the iron oxide agglomerates to form reduced iron; and providing a gap between a discharging apparatus for discharging the reduced iron from the moving hearth reducing furnace and the surface of the moving hearth, the discharging apparatus is raised continuously or intermittently from the surface of the moving hearth in response to the thickness of an iron oxide layer formed on the moving hearth by oxidation of iron oxide powder included in the iron oxide agglomerates.

2. A method for operating a moving hearth reducing furnace according to claim 1, wherein iron oxide powder that is not part of the iron oxide agglomerates is separated from the iron oxide agglomerates, and then the iron oxide agglomerates are fed into the moving hearth reducing furnace.

3. A method for operating a moving hearth reducing furnace according to claim 2, wherein the discharging apparatus is brought into contact with the iron oxide powder deposited on the iron oxide layer on the moving hearth or metallic iron powder formed by reduction of the iron oxide powder, during the operation.

4. A method for operating a moving hearth reducing furnace according to claim 2, wherein the amount of the iron oxide powder fed with the iron oxide agglomerates into the moving hearth reducing furnace per unit time is determined, the amount of metallic iron powder formed by reduction of the iron oxide powder is determined, the amount of the metallic iron powder is converted to a volume A, and the discharging apparatus is raised so that the ratio A/B is 50 or less, wherein B is the spatial volume defined by the product of the increment of the height of the discharging apparatus and the area of the moving hearth.

5. A method for operating a moving hearth reducing furnace according to claim 1, wherein a gap is provided between the discharging apparatus and the surface of the moving hearth or the iron oxide layer and the gap is ¾ or less the average diameter of the iron oxide agglomerates.

6. A method for operating a moving hearth reducing furnace according to claim 2, wherein the iron oxide layer on the moving hearth is periodically scraped off.

7. A method for operating a moving hearth reducing furnace according to claim 6, wherein the surface of the iron oxide layer is preliminarily oxidized using an oxidizing burner and is scraped off by a vertically movable cutter provided behind the oxidizing burner.

8. A method for operating a moving hearth reducing furnace, the method comprising feeding iron oxide agglomerates incorporated with a carbonaceous material onto a moving hearth of a moving hearth reducing furnace;

reducing the iron oxide agglomerates to form reduced iron; and providing a gap between a discharging apparatus for discharging the reduced iron from the moving hearth reducing furnace and the surface of the moving hearth, wherein iron oxide powder included in the iron oxide agglomerates, metallic iron powder formed by reduction of the iron oxide powder, and metallic iron powder formed when the reduced iron is discharged from the furnace are evacuated together with exhaust gas through a duct provided in the vicinity of the discharging apparatus and a feeder for feeding the iron oxide agglomerates.

9. A method for operating a moving hearth reducing furnace, the method comprising:

feeding iron oxide agglomerates incorporated with a carbonaceous material onto a moving hearth of a moving hearth reducing furnace;

reducing the iron oxide agglomerates to form reduced iron; and providing a gap between a discharging apparatus for discharging the reduced iron from the moving hearth reducing furnace and the surface of the moving hearth, wherein the discharging apparatus is an electromagnet unit which reciprocally moves in the radial direction of the moving hearth reducing furnace, and which attracts and discharges simultaneously the reduced iron and the metallic iron powder from the moving hearth reducing furnace.

10. A method for operating a moving hearth reducing furnace according to claim 9, wherein the reduced iron metallic iron powder formed by reduction of iron oxide powder included in the iron oxide agglomerates, and metallic iron powder formed when the reduced iron is discharged from the furnace are simultaneously discharged from the furnace through the discharging apparatus.

11. A method for operating a moving hearth reducing furnace according to claim 10, wherein the discharging apparatus is a header blowing an inert gas or a reducing gas, and the reduced iron and the metallic iron powder are simultaneously discharged from the moving hearth reducing furnace by blowing the inert or reducing gas in the radial direction of the moving hearth reducing furnace through the header.

12. A method for operating a moving hearth reducing furnace, the method comprising:

feeding iron oxide agglomerates incorporated with a carbonaceous material onto a moving hearth of a moving hearth reducing furnace;

reducing the iron oxide agglomerates to form reduced iron;

providing a gap between a vertically movable discharging apparatus and the surface of the moving hearth; and adjusting the gap with the discharging apparatus, wherein the vertically movable discharging apparatus is for discharging the reduced iron from the moving hearth reducing furnace.

* * * * *

UNITED STATES PATENT AND TRADEMARK OFFICE

CERTIFICATE OF CORRECTION

PATENT NO. : 6,251,161 B1
DATED : June 26, 2001
INVENTOR(S) : Tateishi et al.

It is certified that error appears in the above-identified patent and that said Letters Patent is hereby corrected as shown below:

Column 7,
Line 10, "hearth 2 er operation" should read -- hearth 2 after operation --
Table 1, "Metal Rate (%) in Reduced Iron Agglomerates" should read -- Metallization (%) in Reduced Iron Agglomerates --

Column 8,
Table 2, "Rate (%) of Metallic iron powder in Reduced Iron Agglomerates" should read -- Metallization (%) in Reduced Iron Agglomerates --
Table 3, "Rate (%) of Metallic iron powder in Reduced Iron Agglomerates" should read -- Metallization (%) in Reduced Iron Agglomerates --

Signed and Sealed this

Ninth Day of April, 2002

*Attest:*

*Attesting Officer*

JAMES E. ROGAN
*Director of the United States Patent and Trademark Office*